US005533953A

United States Patent [19]

Lui et al.

[11] Patent Number: 5,533,953

[45] Date of Patent: Jul. 9, 1996

[54] RIDING-TYPE EXERCISER

[76] Inventors: Gin-Fun Lui, No. 7, Lane 1139, Chia-Hou Rd., Hou-Li Hsiang; Richard Liao, No. 263, Tzu-Te Rd., Ta-Li City, both of Taichung Hsien, Taiwan

[21] Appl. No.: 528,670

[22] Filed: Sep. 15, 1995

[51] Int. Cl.[6] ..... A63B 69/06

[52] U.S. Cl. ..... 482/96; 482/95; 482/72; 482/57

[58] Field of Search ..... 482/95, 96, 57, 482/72, 51, 57, 71, 111, 148; 472/1.182, 1.183, 1.192, 1.203, 1.204, 106, 110; D21/191, 198

[56] References Cited

U.S. PATENT DOCUMENTS

| | | | |
|---|---|---|---|
| 4,743,010 | 5/1988 | Geraci | 482/96 |
| 5,356,358 | 10/1994 | Chen | 482/96 |
| 5,366,428 | 11/1995 | Liao | 482/96 |
| 5,421,795 | 6/1995 | Chen | 482/96 |
| 5,429,568 | 7/1995 | Chen | 482/57 |
| 5,458,553 | 10/1995 | Wu | 482/72 |
| 5,464,378 | 11/1995 | Yu | 482/95 |

*Primary Examiner*—Jerome Donnelly

*Attorney, Agent, or Firm*—Cushman Darby & Cushman

[57] ABSTRACT

A riding-type exerciser includes a base frame and a seat unit having an elongated seat frame with a front portion that extends downwardly from a rear portion thereof and that is mounted pivotally on the base frame adjacent to the front end of the base frame. The seat unit further includes a seat member mounted on the rear portion of the seat frame. An elongated support unit has a bottom portion which is mounted pivotally on the base frame between the front portion of the seat frame and the rear end of the base frame. A pull unit includes an elongated pull beam having a rear portion that is mounted pivotally to the front portion of the seat frame and to a top portion of the support unit, and a handlebar mounted on a front portion of the pull beam. A pedal unit includes a support beam having a lower end mounted pivotally on the base frame adjacent to the front end of the base frame, and a pair of pedal plates mounted on two sides of the support beam. An elongated linking member has a first end connected pivotally to the rear portion of the pull beam and a second end connected pivotally to the support beam. A resistance cylinder has a cylinder body and a piston shaft extending retractably into the cylinder body. The resistance cylinder is mounted pivotally on the base frame adjacent to the rear end of the base frame and on the support unit.

8 Claims, 6 Drawing Sheets

RIDING-TYPE EXERCISER

BACKGROUND OF THE INVENTION

1. Field of the Invention

The invention relates to an exerciser, more particularly to a riding-type exerciser which enables the user to exercise upper and lower parts of his body at the same time.

2. Description of the Related Art

Referring to FIG. 1, a conventional riding-type exerciser is shown to comprise a base frame 10 which includes a parallel pair of inverted U-shaped side frames 100. A seat support unit 11 includes a parallel pair of support shafts 110 having intermediate portions which extend between and which are pivoted to rear portions of the side frames 100. A seat member 12 is mounted on the top ends of the support shafts 110. A drive shaft 13 extends between and is pivoted to front portions of the side frames 100. A handlebar unit 14 is mounted pivotally on the top end of the drive shaft 13. The bottom end of the drive shaft 13 is provided with a roller 15. A slide shaft 16 has a rear end connected pivotally to bottom ends of the support shafts 110, and a front end which is connected to the front portions of the side frames 100 by means of a tension spring 17. The roller 15 is disposed slidably on the slide shaft 16. The front portion of each side frame 100 has a foot plate 18 secured thereon.

Referring to FIG. 2, when the conventional exerciser is in use, the user is seated on the seat member 12 while his hands grasp the handlebar unit 14 and his feet rest on the foot plates 18. Repeated pulling and pushing action on the handlebar unit 14 results in up and down movement of the seat member 12, a movement similar to that experienced when riding a horse.

Since the user's feet are kept stationary on the foot plates 18, only the arms and waist of the user are exercised when the conventional exerciser is in use. The conventional exerciser is incapable of exercising the lower body of the user. In addition, it is noted that the user's back bends forwardly as the user pulls the handlebar unit 14 toward his body. Repeated bending by the user results in straining of the muscles which can lead to back pain and fatigue. Since the conventional exerciser does not incorporate a back support, it is unable to relax the strained back muscles of the user.

SUMMARY OF THE INVENTION

The object of the present invention is to provide a riding-type exerciser which is capable of overcoming the drawbacks of the aforementioned prior art.

More specifically, the main object of the present invention is to provide a riding-type exerciser which enables the user to exercise upper and lower parts of his body at the same time.

Another object of the present invention is to provide a riding-type exerciser which has a massaging device for supporting and massaging the user's back when the exerciser is in use.

Accordingly, the riding-type exerciser of the present invention comprises:

a base frame having a front end and a rear end;

a seat unit including an elongated seat frame with a rear portion and a front portion that extends downwardly from the rear portion and that has a distal end which is mounted pivotally on the base frame adjacent to the front end of the base frame, the seat unit further including a seat member mounted on the rear portion of the seat frame;

an elongated support unit having a top portion and a bottom portion which is mounted pivotally on the base frame between the front portion of the seat frame and the rear end of the base frame;

a pull unit including an elongated pull beam having a front portion and a rear portion that is mounted pivotally to the front portion of the seat frame and to the top portion of the support unit, and a handlebar mounted on the front portion of the pull beam;

a pedal unit including a support beam having a lower end mounted pivotally on the base frame adjacent to the front end of the base frame, and a pair of pedal plates mounted on two sides of the support beam;

an elongated linking member having a first end connected pivotally to the rear portion of the pull beam and a second end connected pivotally to the support beam;

a resistance cylinder having a cylinder body and a piston shaft extending retractably into the cylinder body, one of the cylinder body and the piston shaft being mounted pivotally on the base frame adjacent to the rear end of the base frame, the other one of the cylinder body and the piston shaft being mounted pivotally to the support unit; and a massaging device including: a support beam mounted on the rear portion of the seat frame, the support beam having a top end; a curved connecting bar having top and bottom portions and an intermediate portion which is mounted pivotally on the top end of the support beam; and two massaging wheel sets, each being mounted rotatably on two sides of the connecting bar at a respective one of the top and bottom portions of the connecting bar.

The massaging device further includes: a mounting tube mounted pivotally on the rear portion of the seat frame, the mounting tube confining a rectangular through-hole therethrough, the support beam being formed as an elongated rectangular beam that extends slidably into the through-hole of the mounting tube; locking means for locking releasably the support beam to the mounting tube; and a spring plate formed as an elongated strip which has a first end mounted on the mounting tube and a second end mounted on the rear portion of the seat frame.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
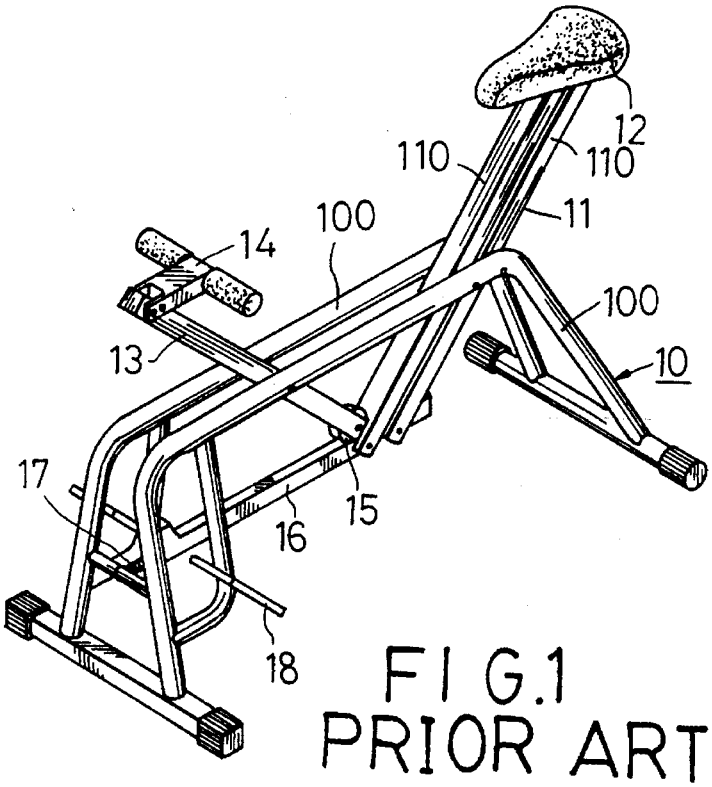
FIG.1 PRIOR ART
FIG. 1 is a perspective view of a conventional riding-type exerciser.
Figure 2:
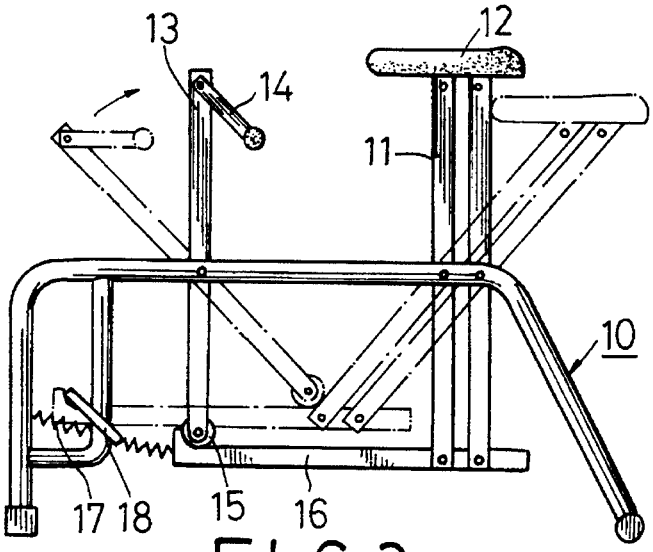
FIG.2 PRIOR ART
FIG. 2 is a schematic view illustrating operation of the conventional riding-type exerciser.
Figure 3:
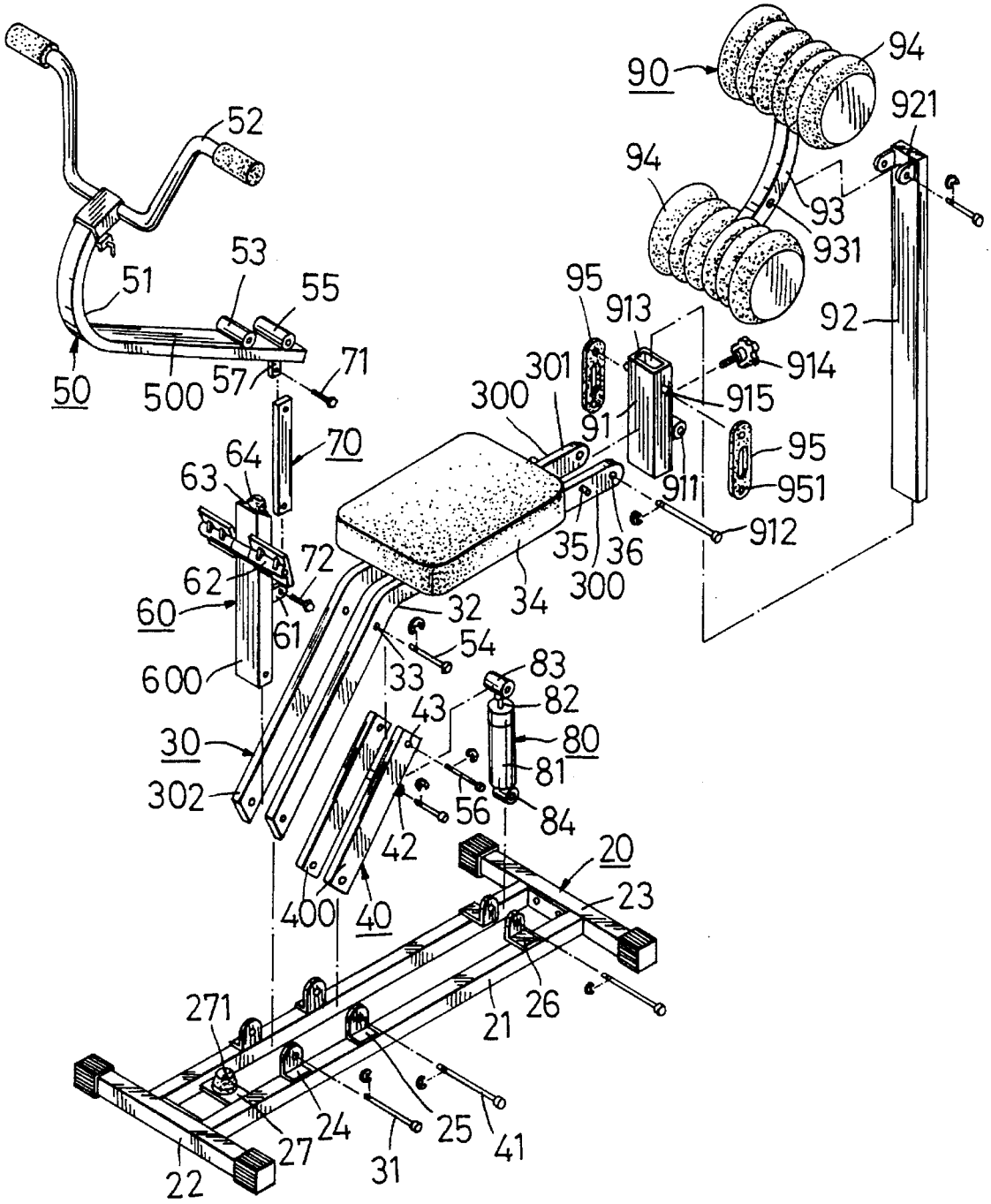
FIG. 3 is an exploded view of the preferred embodiment of a riding-type exerciser according to the present invention.
Figure 4:
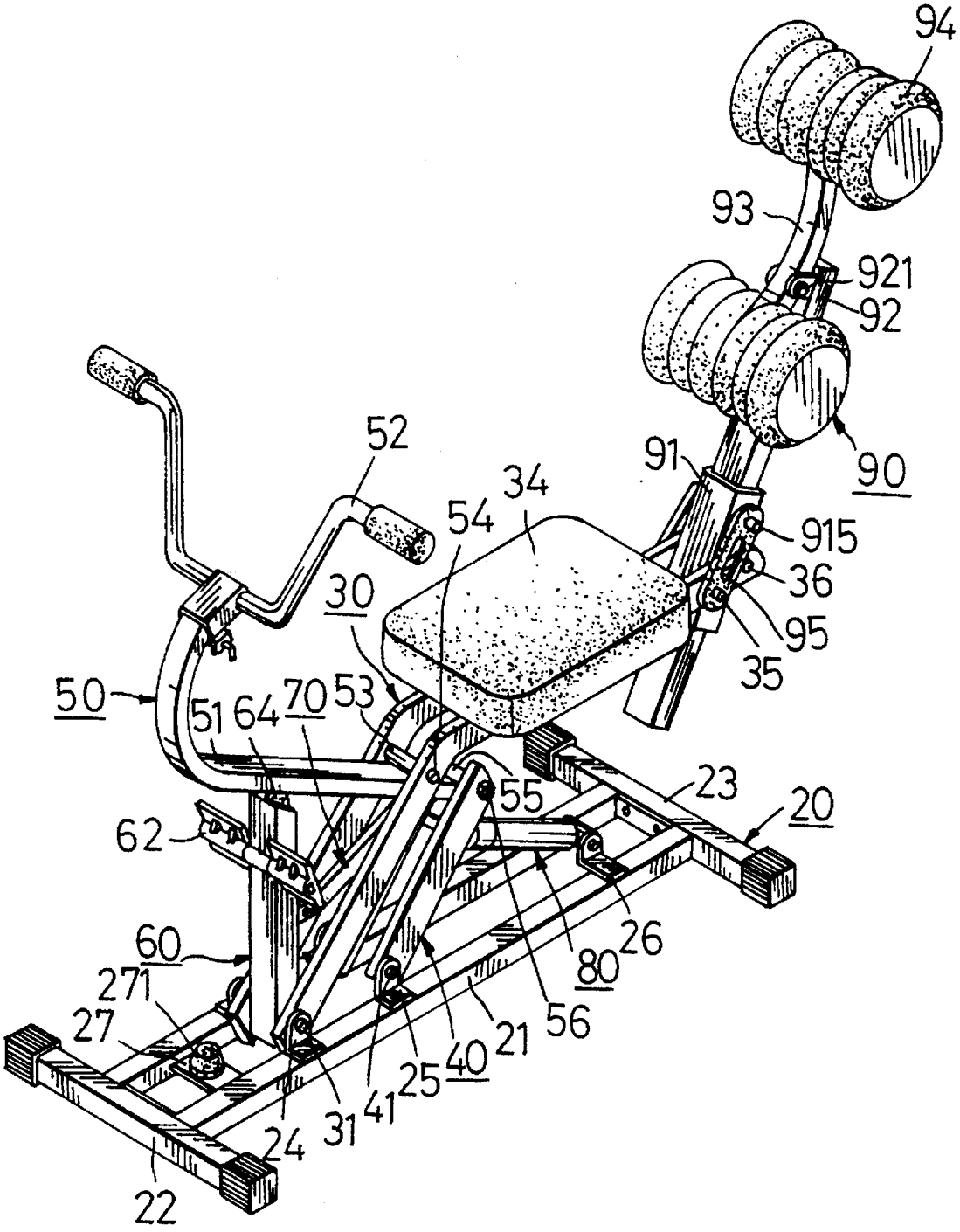
FIG. 4 is a perspective view illustrating assembly of the preferred embodiment.

Referring to FIGS. 3 and 4, the preferred embodiment of a riding-type exerciser according to the present invention is shown to comprise a base frame 20, a seat unit 30, an elongated support unit 40, a pull unit 50, a pedal unit 60, an elongated linking member 70, a resistance cylinder 80 and a massaging device 90.

The base frame 20 includes a parallel pair of elongated base beams 21, a front beam 22 connected transversely to front ends of the base beams 21, and a rear beam 23 connected transversely to rear ends of the base beams 21. The base beams 21 are provided with a pair of first pivot seats 24 adjacent to the front beam 22, a pair of second pivot seats 25, and a pair of third pivot seats 26 adjacent to the rear beam 23. The second pivot seats 25 are disposed between the first and third pivot seats 24, 26. A support plate 27 bridges the base beams 21 and is located between the first pivot seats 24 and the front beam 22. The support plate 27 has a resilient buffer 271 secured thereon.

The seat unit 30 includes an elongated seat frame and a seat member 34. The seat frame includes a parallel pair of elongated seat posts 300 and has a rear portion 301 and a front portion 303 which inclines downwardly from the rear portion 301. A screw fastener 31 mounts pivotally the distal section of the front portion 303 of the seat frame to the first pivot seats 24. Each of the seat posts 300 is further formed with a pivot hole 33 at the front portion 303 of the seat frame adjacent to a juncture 32 of the front and rear portions 301, 303. The seat member 34 is mounted on the rear portion 301 of the seat frame. Each of the seat posts 300 is additionally formed with a lateral retaining pin 35 and a mounting hole 36 at the rear portion 301 of the seat frame.

The support unit 40 includes a parallel pair of elongated support posts 400. A screw fastener 41 mounts pivotally the bottom portion of the support posts 400 to the second pivot seats 25. Each of the support posts 400 has one side formed with a pivot seat 42 and a top portion formed with a pivot hole 43.

The pull unit 50 includes an elongated pull beam 500 having a front portion formed as an upwardly curving neck 51. A handlebar 52 is mounted pivotally on one end of the neck 51. The pull beam 500 further has a rear portion formed with a first fastener tube 53 which is disposed between the seat posts 300 and which is aligned with the pivot holes 33. A screw fastener 54 extends through the pivot holes 33 and the first fastener tube 53 to mount pivotally the pull beam 500 to the seat posts 300. The rear portion of the pull beam 500 is further formed with a second fastener tube 55 which is parallel to the first fastener tube 53 and which is disposed on one side of the first fastener tube 53 opposite to the neck 51, and a pivot seat 57 which extends downwardly. The second fastener tube 55 is disposed between the support posts 400 and is aligned with the pivot holes 43. A screw fastener 56 extends through the pivot holes 43 and the second fastener tube 55 to mount pivotally the pull beam 500 to the support unit 40.

The pedal unit 60 includes a support beam 600 with a lower end which extends between the seat posts 300 at the front portion 303 of the seat frame and which is secured pivotally on the base frame 20 by the screw fastener 31. A pivot seat 61 projects from a rear face of the support beam 600. A pair of pedal plates 62 are mounted pivotally on two sides of the support beam 600. The support beam 600 has an inclined top end face 63, and a resilient buffer 64 is secured on the end face 63. The buffer 64 supports the pull beam 500 thereon when the exerciser is not in use.

The linking member 70 has a first end connected pivotally to the pivot seat 57 by a screw fastener 71, and a second end connected pivotally to the pivot seat 61 by a screw fastener 72.

The resistance cylinder 80 is a conventional hydraulic cylinder which has a cylinder body 81 and a piston shaft 82 that extends retractably into the cylinder body 81. In this embodiment, the piston shaft 82 has a distal end formed with a ring connector 83 which is connected pivotally to the pivot seats 42 on the support posts 400, while the cylinder body 81 has a bottom end formed with a ring connector 84 which is connected pivotally to the third pivot seats 26.

The massaging device 90 is mounted on the rear portion 301 of the seat frame and includes a mounting tube 91, a support beam 92, a connecting bar 93, two massaging wheel sets 94 and two spring plates 95.

The mounting tube 91 extends between the seat posts 300 at the rear portion 301 of the seat frame and has a rear face formed with a tubular connector 911. A screw fastener 912 extends through the mounting holes 36 and the tubular connector 911 to mount pivotally the mounting tube 91 on the rear portion 301 of the seat frame. The mounting tube 91 confines a rectangular through-hole 913 therethrough. The rear face of the mounting tube 91 has a locking knob 914 secured threadedly thereon. The two sides of the mounting tube 91 are formed with lateral retaining pins 915.

The support beam 92 is formed as an elongated rectangular beam that extends slidably into the through-hole 913 of the mounting tube 91. The locking knob 914 extends into the through-hole 913 and abuts against the support beam 92 to lock releasably the same in the mounting tube 91. The support beam 92 has a top end formed with a pair of pivot seats 921.

The connecting bar 93 is a curved bar which has an intermediate portion that extends between the pivot seats 921 and that is formed with a pivot hole 931. A screw fastener 932 extends through the pivot hole 931 and the pivot seats 921 to mount pivotally the connecting bar 93 to the support beam 92.

Each of the massaging wheel sets 94 is mounted rotatably on two sides of the connecting bar 93 at a respective one of the top and bottom portions of the connecting bar 93.

Each of the spring plates 95 is formed as an elongated strip and has a pin hole 951 formed on each of its two ends for connection with one of the retaining pins 915 on the mounting tube 91 and one of the retaining pins 35 on the rear portion 301 of the seat frame.

Figure 5:
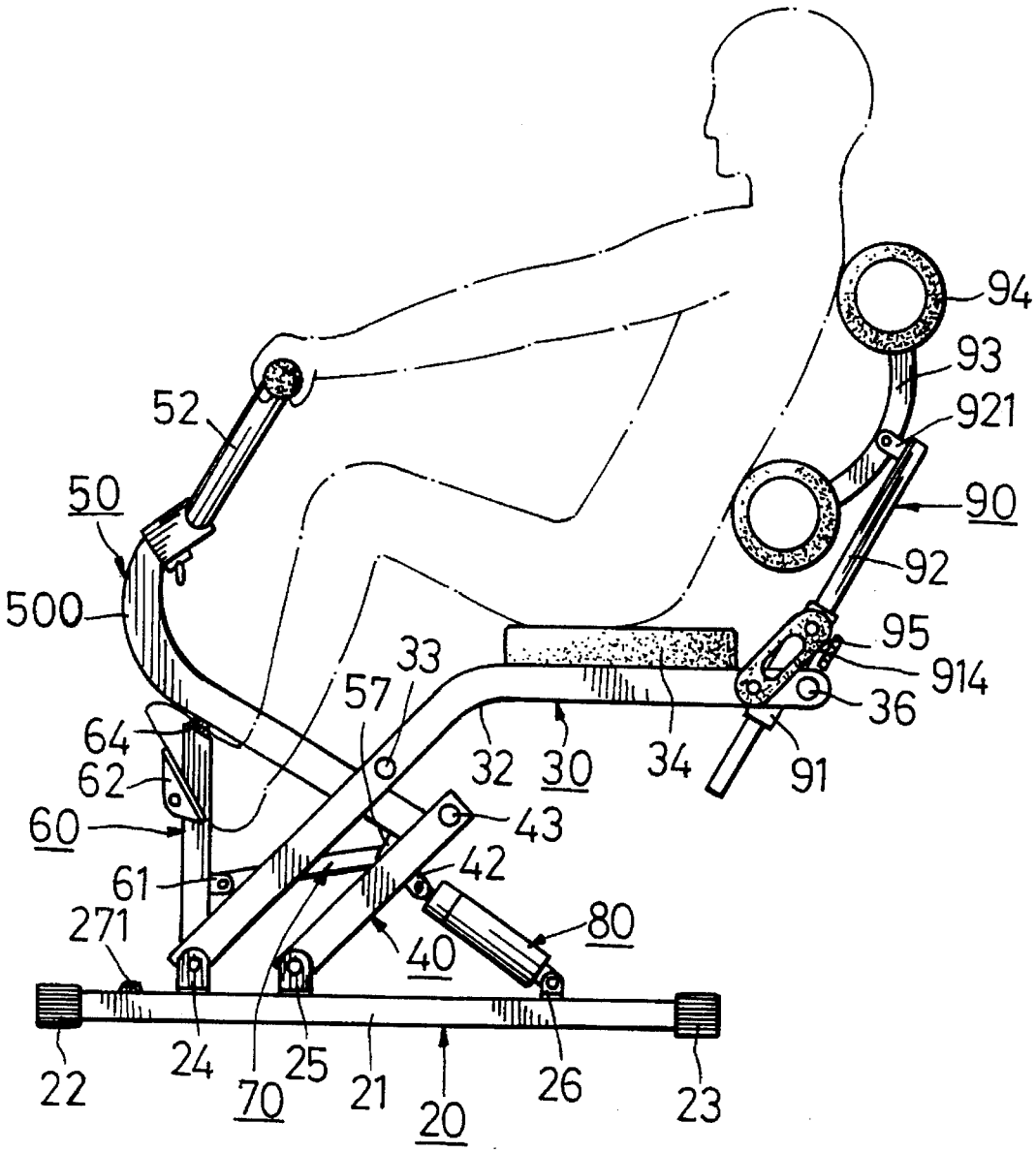
FIGS. 5 and 6 are schematic views illustrating the preferred embodiment when in use.

Referring to FIG. 5, when the riding-type exercise of this invention is in use, the pull beam 500 initially rests on the resilient buffer 64, and the user is seated on the seat member 34. The weight of the user is transmitted to the support unit 40 via the pull beam 500, thus forcing the piston shaft 82 into the cylinder body 81 of the resistance cylinder 80. The user's hands grasp the handlebar 52 while his feet are disposed on the pedal plates 62. The handlebar 52 and the pedal plates 62 are mounted pivotally and respectively on the pull beam 500 and the support beam 600 to permit adjustments in the positions of the same so as to correspond with the lengths of the user's arms and legs.

Figure 6:
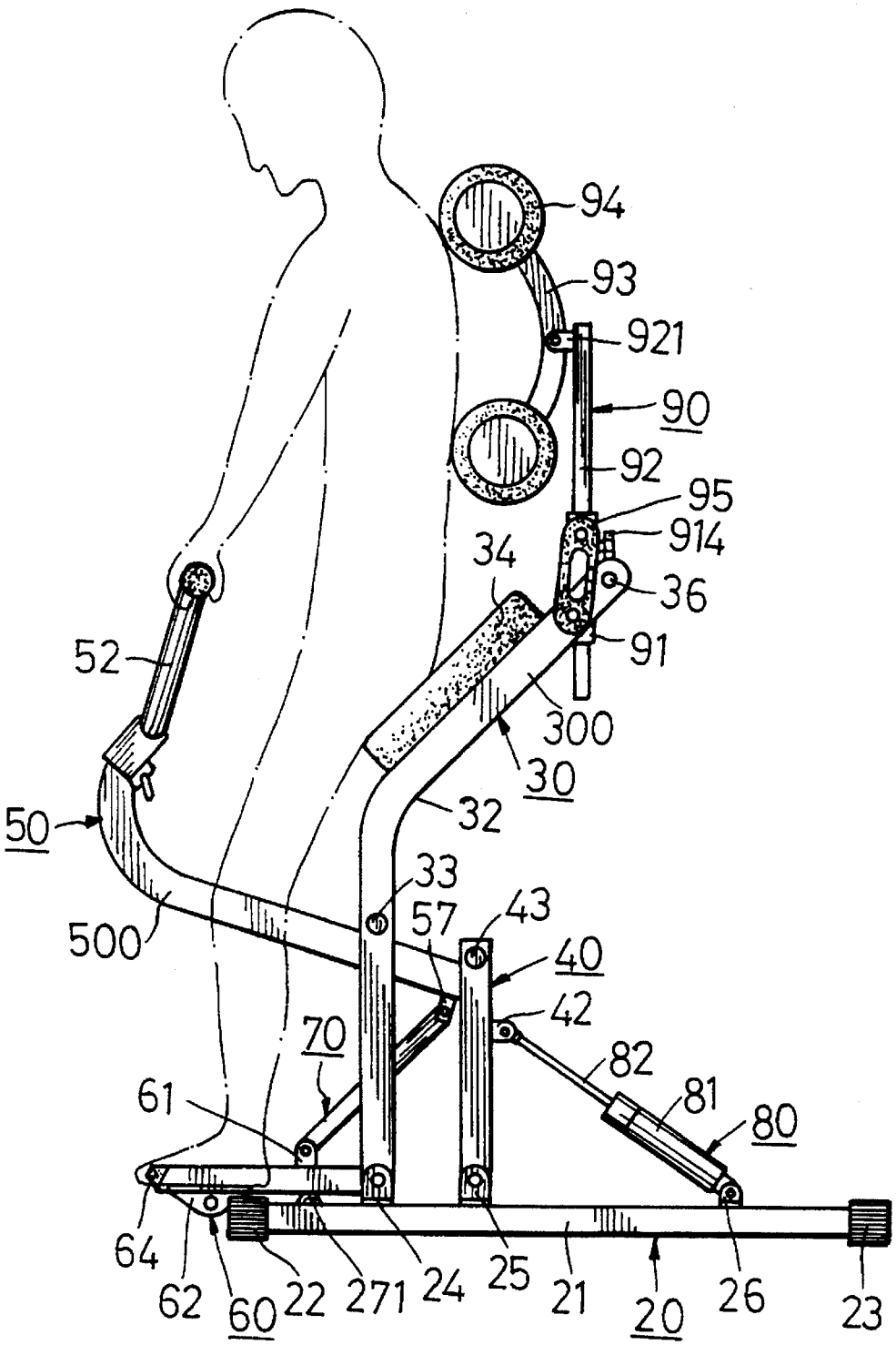

Referring to FIG. 6, when the user pulls the handlebar 52 toward his body, the pedal unit 60 pivots downwardly about the first pivot seats 24 until the support beam 600 abuts against the resilient buffer 271. Movement of the handlebar 52 in this direction causes the pull unit 50 to pull the support unit 40 to pivot about the second pivot seats 25 in a direction toward the front beam 22, thereby pulling the piston shaft 82 away from the cylinder body 81. The pull beam 500, the seat posts 300, the base frame 20 and the support unit 40 cooperate to form a parallel linkage. Thus, pivoting movement of the support unit 40 results in corresponding movement of the seat unit 30. At this time, the seat member 34 and the massaging device 90 rise with the rear portion of the seat frame. This illustrates how the upper and lower body parts of the user are stretched at the same time when the exerciser of this invention is in use.

Figure 7:
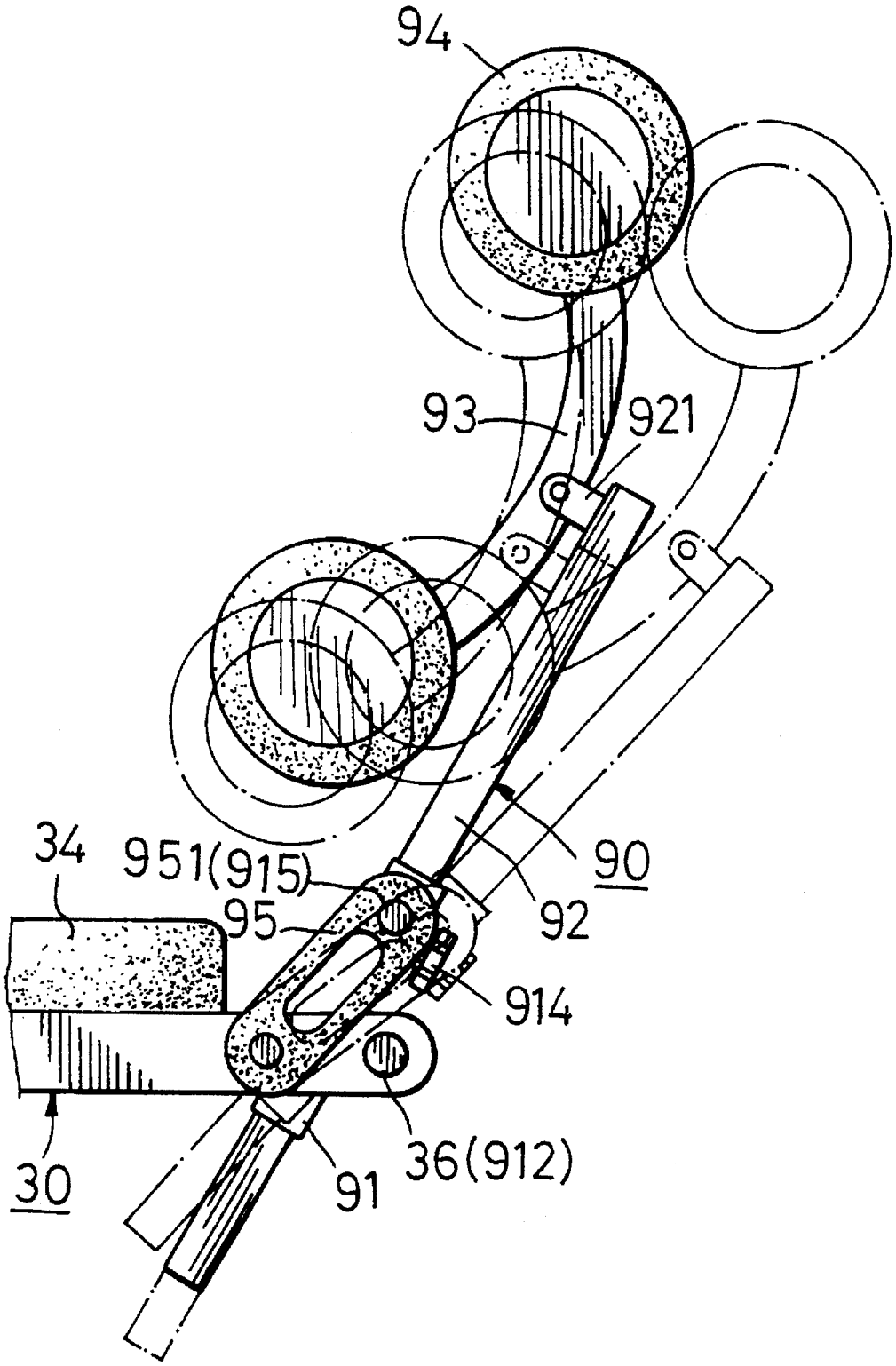
FIG. 7 illustrates the operation of the massaging device of the preferred embodiment when the exerciser is in use.

FIG. 7 illustrates the operation of the massaging device 90 when the exerciser of this invention is in use. The massaging wheel sets 94 serve to support the back and waist portions of the user when the exerciser is in use. Note that the mounting tube 91 of the massaging device 90 is mounted pivotally on the seat unit 30. The entire massaging device 90 pivots rearwardly when the back portion of the user rests on the corresponding massaging wheel set 94. The spring plates 95, however, ensure that contact between the massaging device 90 and the user is maintained. As the user repeatedly pulls and pushes the handlebar 52, the massaging wheels sets 94 roll along the back and waist portions of the user to provide a massaging effect for relaxing strained muscles of the user.

The massaging device 90 can be adjusted to suit the body size of the user. To adjust the massaging device 90, the locking knob 914 is loosened, and the support beam 92 is retracted into or extended from the mounting tube 91. The locking knob 914 is tightened to lock the support beam 92 to the mounting tube 91 after the massaging device 90 has been adjusted.

It has thus been shown that the riding-type exerciser of the present invention enables the user to exercise upper and lower parts of his body at the same time. In addition, the massaging device 90 supports and massages the user's back when the exerciser is in use to effectively minimize straining of the muscles. The objectives of the present invention are thus met.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

We claim:

1. A riding-type exerciser, comprising:

a base frame having a front end and a rear end;

a seat unit including an elongated seat frame with a rear portion and a front portion that extends downwardly from said rear portion and that has a distal end which is mounted pivotally on said base frame adjacent said front end of said base frame, said seat unit further including a seat member mounted on said rear portion of said seat frame;

an elongated support unit having a top portion and á bottom portion which is mounted pivotally on said base frame between said front portion of said seat frame and said rear end of said base frame;

a pull unit including an elongated pull beam having a front portion and a rear portion that is mounted pivotally to said front portion of said seat frame and to said top portion of said support unit, and a handlebar mounted on said front portion of said pull beam;

a pedal unit including a support beam having a lower end mounted pivotally on said base frame adjacent said front end of said base frame, and a pair of pedal plates mounted on two sides of said support beam;

an elongated linking member having a first end connected pivotally to said rear portion of said pull beam and a second end connected pivotally to said support beam; and a resistance cylinder having a cylinder body and a piston shaft extending retractably into said cylinder body, one of said cylinder body and said piston shaft being mounted pivotally on said base frame adjacent said rear end of said base frame, the other one of said cylinder body and said piston shaft being mounted pivotally to said support unit.

2. The riding-type exerciser as claimed in claim 1, wherein said seat frame includes a parallel pair of elongated seat posts, said support unit including a parallel pair of elongated support posts, said pull beam of said pull unit extending between said seat posts and between said support posts and being mounted pivotally to said seat posts and said support posts.

3. The riding-type exerciser as claimed in claim 2, wherein said pull beam, said base frame, said seat posts and said support posts cooperatively form a parallel linkage.

4. The riding-type exerciser as claimed in claim 1, further comprising a resilient buffer mounted on said base frame between said front end of said base frame and said front portion of said seat frame.

5. The riding-type exerciser as claimed in claim 1, wherein said support beam has an inclined top end face, said pedal unit further including a resilient buffer secured on said inclined top end face.

6. The riding-type exerciser as claimed in claim 1, wherein said handlebar is mounted pivotally on said front portion of said pull beam, and said pedal plates are mounted pivotally on said support beam.

7. The riding-type exerciser as claimed in claim 1, further comprising a massaging device which includes:

a support beam mounted on said rear portion of said seat frame, said support beam having a top end;

a curved connecting bar having top and bottom portions and an intermediate portion which is mounted pivotally on said top end of said support beam; and two massaging wheel sets, each being mounted rotatably on two sides of said connecting bar at a respective one of said top and bottom portions of said connecting bar.

8. The riding-type exerciser as claimed in claim 7, wherein said massaging device further includes:

a mounting tube mounted pivotally on said rear portion of said seat frame, said mounting tube confining a rectangular through-hole therethrough, said support beam being formed as an elongated rectangular beam that extends slidably into said through-hole of said mounting tube;

locking means for locking releasably said support beam to said mounting tube; and a spring plate formed as an elongated strip which has a first end mounted on said mounting tube and a second end mounted on said rear portion of said seat frame.

* * * * *